US005615811A

United States Patent [19]

Bell et al.

[11] Patent Number: 5,615,811

[45] Date of Patent: Apr. 1, 1997

[54] RETRACTABLE CARRYING DEVICE

[75] Inventors: Dennis L. Bell, Greeley; Barry B. Hewitt, Bailey; John P. McCarty, Greeley, all of Colo.

[73] Assignee: The Hunter Company, Westminster, Colo.

[21] Appl. No.: 636,070

[22] Filed: Apr. 22, 1996

[51] Int. Cl.[6] ..... F41C 23/02; F41C 33/00

[52] U.S. Cl. ..... 224/150; 224/258; 224/578; 224/916; 24/300

[58] Field of Search ..... 224/150, 258, 224/578, 916; 24/300, 304, 200, 482, 265 BC, 265 AL, 68 C, 68 D, 442; 292/177, 229; 177/225

[56] References Cited

U.S. PATENT DOCUMENTS

| | | | |
|---|---|---|---|
| D. 325,470 | 4/1992 | Harms | 224/258 |
| 487,041 | 11/1892 | Ziegler | 24/300 |
| 3,955,734 | 5/1976 | Reese | 24/265 AL |
| 4,858,801 | 8/1989 | Sameniego | 224/258 |
| 5,261,581 | 11/1993 | Harden, Sr. | 224/916 |
| 5,370,286 | 12/1994 | Newman | 224/578 |
| 5,421,069 | 6/1995 | Hamilton | 24/300 |

*Primary Examiner*—Henry J. Recla
*Assistant Examiner*—Kam R. Shah
*Attorney, Agent, or Firm*—Michael A. Capraro

[57] ABSTRACT

A retractable carrying device that effectively positions an object snugly against a user's body allowing the user to carry the object from their shoulder for long periods of time without stress and irritation. The retractable carrying device maintains tension on receiving means thereby preventing undesirable noise, and also automatically and tensionally adjusts when the retractable carrying device is utilized as a stabilizing aid. The retractable carrying device is constructed with a first elongated flexible securing means, a second elongated flexible securing means, and a retractable mechanism, the retractable mechanism being enveloped by shielding means. The retractable mechanism has elastic properties and is of the type that can be stretched or extended when an opposing directional force is applied to the retractable mechanism, thereby increasing the effective length of the retractable mechanism, and which will then return or retract to its original length when the opposing directional force is released. Flexible elongated friction reducing means provide a smooth, low friction surface against which the retractable mechanism can easily slide when the retracting mechanism operates, ensuring free movement of the retracting mechanism within the shielding means. A constant re-adjusting effect is created when the retractable carrying device is in use. The constant re-adjusting effect allows the retractable carrying device to have a shock absorbing effect allowing a user to comfortably carry an object for long periods of time and to automatically and tensionally adjust when the retractable carrying device is utilized as a stabilizing aid.

27 Claims, 5 Drawing Sheets

RETRACTABLE CARRYING DEVICE

BACKGROUND OF THE INVENTION

This invention relates generally to carrying devices and more specifically to a new and novel retractable carrying device. The new and novel retractable carrying device is designed to be used with a variety of objects that can be carried by a user such as firearms, golf bags, camera bags, tripods, sports bags, luggage and similar objects, and is specifically designed for use with objects whose weight is carried from a user's shoulder.

While there are a wide variety of carrying devices that allow a user to carry an object from the user's shoulder, these carrying devices are often uncomfortable, especially after the user has been carrying an object for an extended period of time. For example, and by way of illustration only, when a user is carrying a firearm for the purpose of hunting, they must often walk long distances in search of the intended game. The user generally carries the firearm behind them, the firearm being slung over a shoulder and held in place by a carrying device, the carrying device often being a sling. These slings are generally a long strap, one end of the strap being fastened to the forestock of the firearm and the other end of the strap being fastened to the stock butt of the firearm. The ends of the strap are generally fastened to receiving means, such as movable swivels, which are attached to the forestock and stock butt of the firearm. The strap is then placed over the user's shoulder to carry the weight of the firearm. After long periods of time, prior art carrying devices become uncomfortable and the user's shoulder is often irritated. Some carrying devices may have additional padding at that portion of the carrying device which is placed over the shoulder, but the additional padding alone does little to relieve the stress and irritation caused by the constant impact of the prior art carrying device against the user's shoulder and body as the user walks. Similar problems are encountered when the user is carrying other objects such as golf bags, camera bags, tripods, sports bags, luggage or other objects that may be carried from a user's shoulder.

Another specific problem occurs with prior art carrying devices that may be used with firearms, as described in the example above, when the user removes the firearm, and thus the prior art carrying device, from their shoulder. When a user is hunting as before described, it is desirable to remain as quiet as possible to avoid alerting any nearby game to the hunter's presence. It is especially desirable to remain quiet when the hunter is able to visually identify an appropriate game target within firing range and is removing the firearm from the carrying position over the shoulder into a proper aiming position. When a hunter removes the firearm from the carrying position, or even when the hunter simply repositions the firearm in any manner, slack is created in the straps of the prior art carrying device allowing the movable swivels, attached to the stock of the firearm, to rotate and arc thereby creating undesirable noise, and further, to strike the stock of the firearm thereby creating additional undesirable noise.

Also, another specific problem encountered with prior art carrying devices that may be used with firearms, as described in the example above, is evident when the user utilizes the prior art carrying device or sling to assist in the aiming of the firearm. For example, when a user is hunting as before described, situations arise where the user must stand, kneel or sit and aim the firearm without the benefit of any natural or artificial firearm or gun rest. Many users will place their non-trigger hand through a loop created by the prior art carrying device or sling and grasp the forestock of the firearm, thereby oppositely and partially encircling their forearm and upper arm with the sling. The user can then exert pressure against the sling to stabilize and steady the firearm before firing. However, it is often difficult to achieve sufficient stability with these types of prior art carrying devices since such stability is dependent on the relative length of the prior art carrying device. If a user has adjusted the sling so that it is loose when carried over the shoulder, the sling will be too long to allow the user to achieve the required pressure to stabilize the firearm when the user attempts to utilize the sling to steady the aiming of the firearm. Similarly, if the user has adjusted the sling so that it is taught when carried over the shoulder, it will be difficult for the user to insert their forearm and upper arm into the loop created by the prior art carrying device or sling and the required pressure for stability will not be achieved.

SUMMARY OF THE INVENTION

To overcome the before described considerations and problems inherent in and encountered with prior art carrying devices, there is provided by the subject invention a unique retractable carrying device that effectively positions an object snugly against the user's body when the object is carried from a user's shoulder. The new and novel retractable carrying device is also designed to allow a user to carry an object from the shoulder for long periods of time without stress and irritation. The new and novel retractable carrying device is further designed to maintain tension on any receiving means, such as movable swivels, to which the new and novel retractable carrying device is fastened, thereby preventing undesirable noise. Additionally, in a situation where the carrying device is used to stabilize an object, the new and novel retractable carrying device is designed to automatically and tensionally adjust when the new and novel retractable carrying device is utilized as a stabilizing aid.

Applicant's new and novel retractable carrying device is constructed with a shielding means having a closed end, an open end and a body. The shielding means is composed of a layered material having at least three layers and envelops an inner retractable mechanism. The first layer is composed of a durable material and provides a tough, durable outer surface. The second layer is open cell foam or other soft, resilient material and provides a cushioning effect. The third layer is a low friction, smooth material and provides a smooth surface adjacent to the retractable mechanism and also provides a protective coating over the open cell foam second layer.

The closed end of the shielding means envelops and is fixedly attached to a first elongated flexible securing means having an end, an opposite end and a body. The closed end of the shielding means is attached to the body of the first elongated flexible securing means near the end of the first elongated flexible securing means. In the Preferred Embodiment, the first elongated flexible securing means is formed from a high strength flexible material such as nylon webbing, leather, reinforced vinyl, flexible plastic and other flexible materials. The first elongated flexible securing means is sewn into the closed end of the shielding means with high strength thread.

A second elongated flexible securing means, also formed from a high strength flexible material such as nylon webbing, leather, reinforced vinyl, flexible plastic and other flexible materials, having an end, an opposite end and a body, is movably enveloped by the open end of the shielding means. This allows the second elongated flexible securing means to freely move a pre-determined distance through the body of the shielding means.

A retractable mechanism is also enveloped by the shielding means. The retractable mechanism is comprised of a first connecting means, a retracting means, and a second connecting means in the Preferred Embodiment, the retracting means is formed from an elastic, extendible, resilient material such as latex surgical tubing, rubber tubing, silicon tubing, flat rubber banding, bungee cord and other elastic materials. The retracting means has elastic properties and is of the type that can be stretched or extended when an opposing directional force is applied to the retracting means, thereby increasing the effective length of the retracting means, and which will then return or retract to its original length when the opposing directional force is released.

Also, in the Preferred Embodiment, the first connecting means is a jump ring, split ring, snap ring, quick-link ring and other connecting means having an end, an opposite end and an opening. The end of the first elongated flexible securing means is fixedly attached to the end of the first connecting means. The retracting means, having an end, an opposite end and a body, is fixedly attached to the opposite end of the first connecting means.

A second connecting means having an end, an opposite end, openings, and a gripping means is fixedly attached to the retracting means. In the Preferred Embodiment, the second connecting means is similar to the first connecting means and has been designed to have an opening near the end of the second connecting means through which the opposite end of the retracting means is fixedly attached to the end of the second connecting means, and another opening near the opposite end of the second connecting means through which the second elongated flexible securing means is fixedly attached to the opposite end of the second connecting means. Gripping means are continuously formed on the opposite end of the second connecting means and are designed, in the Preferred Embodiment, as raised pointed areas which engage a portion of the second elongated flexible securing means thereby preventing slippage of the second elongated flexible securing means on the opposite end of the second connecting means.

In another embodiment, a self centering modified connecting means may also be used as a first connecting means or as a second connecting means or both. The modified connecting means is a self-centering jump ring having a centering portion formed in an end of the modified connecting means. The retracting means is fixedly attached to the centering portion of the modified connecting means.

Flexible elongated friction reducing means are fixedly fastened onto the first elongated flexible securing means so that the flexible elongated friction reducing means lay parallel to and adjacent to either side of the first elongated flexible securing means and extends the inner length of the shielding means. The flexible elongated friction reducing means provide a smooth, low friction surface against which the retractable mechanism can easily slide when the retracting mechanism operates, ensuring free movement of the retracting mechanism within the shielding means. In the Preferred Embodiment, the flexible elongated friction reducing means are thin sheets of flexible plastic polymers such as polystyrene, polyethylene, Teflon® and other friction reducing materials.

The shielding means envelops the entire retracting mechanism, insulating the user's shoulder from the retractable mechanism while allowing free movement of the retracting mechanism within the shielding means. Edge portions of the shielding means are sewn together with high strength thread to close and lock the envelope. Thus, the closed end of the shielding means and the edges of the shielding means are sewn shut leaving an open end through which the second elongated flexible securing means can freely move.

The fixed attachment of the shielding means around and to the first elongated flexible securing means creates a static end of the retractable carrying device. The static end of the retractable carrying device allows the body of the second elongated flexible securing means and the second connecting means to be pulled through the open end of the shielding means, when a directional force is applied to the second elongated flexible securing means, thereby extending or stretching the retracting means within the shielding means. When the retracting means is extended or stretched, there is an intrinsic tendency, due to the elastic properties of the retracting means, for the retracting means to return to its original retracted or relaxed state. The tendency of the retracting means to return to the original retracted state urges the second connecting means and the second elongated flexible securing means to return to an upper portion of the shielding means thereby causing the retractable carrying device, and thus a prior art object to which the retractable carrying device is attached, to fit snugly against the user's body.

Since the elastic properties of the retracting means urges the second connecting means and thus, the second elongated flexible securing means to return to the upper portion of the shielding means, a constant re-adjusting effect is created when the retractable carrying device is in use. The constant re-adjusting effect allows the new and novel retractable carrying device to have a shock absorbing effect allowing a user to comfortably carry an object for long periods of time. The shock absorbing effect also maintains constant tension on any receiving means, such as swivels, to which the new and novel retractable carrying device is fastened, thereby preventing undesirable noise while an object is being carried on, removed from the user's shoulder or repositioned.

Additionally, the new and novel retractable carrying device further enhances stability of an object when it is used to stabilize the object. The elastic properties of the retracting, means allows the retractable carrying device to automatically and tensionally adjust when the new and novel retractable carrying device is utilized as a stabilizing aid.

Retaining means in the open end of the shielding means limit lateral movement of the second elongated flexible securing means but do not interfere with the free travel of the second elongated flexible securing means through the open end of the shielding means. The retaining means have also been designed to retain the second connecting means in the unlikely event that the retracting means should break. The retaining means limits the travel of the second connecting means thereby preventing over-extension of the retracting means and increasing the life of the retracting means. In the Preferred Embodiment, the retracting means has been designed to withstand repeated extension and retraction. In the unlikely event that the retracting means should break, the retaining means prevents the second connecting means from traveling past the open end and out of the shielding means thereby allowing a user to continue carrying an object with the new and novel retractable carrying device.

In another embodiment, a modified retractable carrying device has at least two retractable carrying devices fixedly attached one to the other. The at least two retractable carrying devices may be fixedly attached, one to the other, at the opposite end of the first elongated flexible securing means of each of the at least two retractable carrying devices. Alternatively, the first elongated flexible securing means of one of the at least two retractable carrying devices may be fixedly attached to the end of the first connecting means 62 of the other at least two retractable carrying devices. In this embodiment, the modified retractable carrying device is designed to be utilized with heavy prior art objects, for example, luggage, or where an additional shock absorbing effect is desired or preferable.

To achieve the foregoing and other advantages, the present invention provides a new and novel retractable carrying device that effectively positions a prior art object snugly against the user's body when the object is carried from the user's shoulder, allowing the user to carry the object for long periods of time without stress and irritation. The present invention is also further designed to maintain tension on any receiving means to which the new and novel retractable carrying device is fastened, thereby preventing undesirable noise, and is also designed to automatically and tensionally adjust when the new and novel retractable carrying device is utilized as a stabilizing aid.

The more important features of the present invention have been broadly outlined in order that the detailed description thereof that follows may be better understood and in order that the present contribution to the art may be better appreciated. There are additional features of the invention that will be more fully described hereinafter and which, together with the features outlined above, will form the subject matter of the claims appended hereto. Those skilled in the art will appreciate that the conception, upon which the present disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory review the nature and essence of the technical disclosure of the application. The abstract is neither intended to define the invention of the application, which is measured by the claims, nor is it intended to be limiting as to the scope of the invention in any way.

Accordingly, it is an object and advantage of the invention to provide a new and novel retractable carrying device that effectively positions an object snugly against a user's body.

Another object and advantage of the invention is to provide a new and novel retractable carrying device that allows a user to carry an object from the user's shoulder for long periods of time without stress and irritation.

Another object and advantage of the invention is to provide a new and novel retractable carrying device that has a shock absorbing effect when the weight of an object is carried from a user's shoulder by the new and novel retractable carrying device.

Another object and advantage of the invention is to provide a new and novel retractable carrying device that maintains tension on any receiving means to which the new and novel retractable carrying device is fastened, thereby preventing undesirable noise when an object to which the new and novel retractable carrying device is fastened is repositioned.

Another object and advantage of the invention is to provide a new and novel retractable carrying device that automatically and tensionally adjusts when the new and novel retractable carrying device is utilized as a stabilizing aid.

Still another object and advantage of the invention is to provide a new and novel retractable carrying device which may be easily and efficiently manufactured and marketed.

Yet another object and advantage of the invention is to provide a new and novel retractable carrying device which is of durable and reliable construction.

These and other objects and advantages will become apparent from review of the drawings and from a study of the Description of the Preferred Embodiment relating to the drawings which has been provided by way of illustration only.

DESCRIPTION OF THE PREFERRED EMBODIMENT

Figure 1:
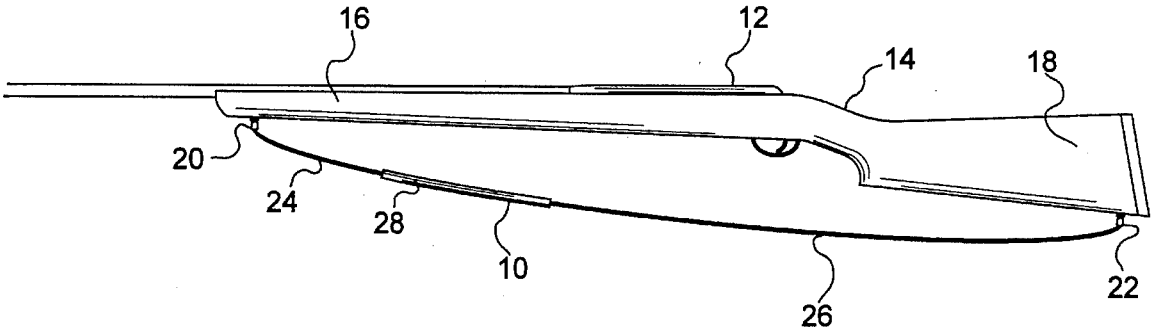
FIG. 1 is a side view of applicant's new and novel retractable carrying device in position on a prior art firearm.

Referring to the drawings in general and in particular to FIG. 1 of the drawings, there is shown applicant's new and novel retractable carrying device, shown generally by the numeral 10, in position on a prior art firearm shown generally by the numeral 12. The prior art firearm 12 is shown in the Preferred Embodiment and in FIG. 1 of the drawings for purposes of illustration only. Applicant's new and novel retractable carrying device 10 has been designed to be utilized with a variety of prior art objects such as firearms, golf bags, camera bags, tripods, sports bags, luggage and similar objects. The new and novel retractable carrying device is also designed to maintain tension on any receiving means, such as swivels, to which the new and novel retractable carrying device is fastened, thereby preventing the receiving means from creating undesirable noise when an object to which the new and novel retractable carrying device is fastened is repositioned, and has also been designed to automatically and tensionally adjust when the new and novel retractable carrying device is utilized as a stabilizing aid.

Still referring to FIG. 1 of the drawings, the prior art firearm 12 has a stock, shown generally by the numeral 14, having a forestock 16 and a stock butt portion 18. Receiving means 20 and 22 are fixedly attached to the forestock 16 and stock butt portion 18 respectively. The receiving means 20 and 22 are shown as swivels in FIG. 1 for purposes of clarity. Other receiving means known in the art may also be used and are considered to be within the spirit and scope of the applicant's invention.

A first elongated flexible securing means 24 of retractable carrying device 10 is removably attached to receiving means or swivel 20 at the forestock 16 of the prior art firearm 12. A second elongated flexible securing means 26 of retractable carrying device 10 is removably attached to receiving means or swivel 22 at the stock butt portion 18 of the prior art firearm 12. A shielding means 28 is interposed between the first elongated flexible securing means 24 and the second elongated flexible securing means 26 of the retractable carrying device 10. The removable attachment of the new and novel retractable carrying device 10 to receiving means 20 and 22 will be discussed more fully hereinafter.

Figure 2:
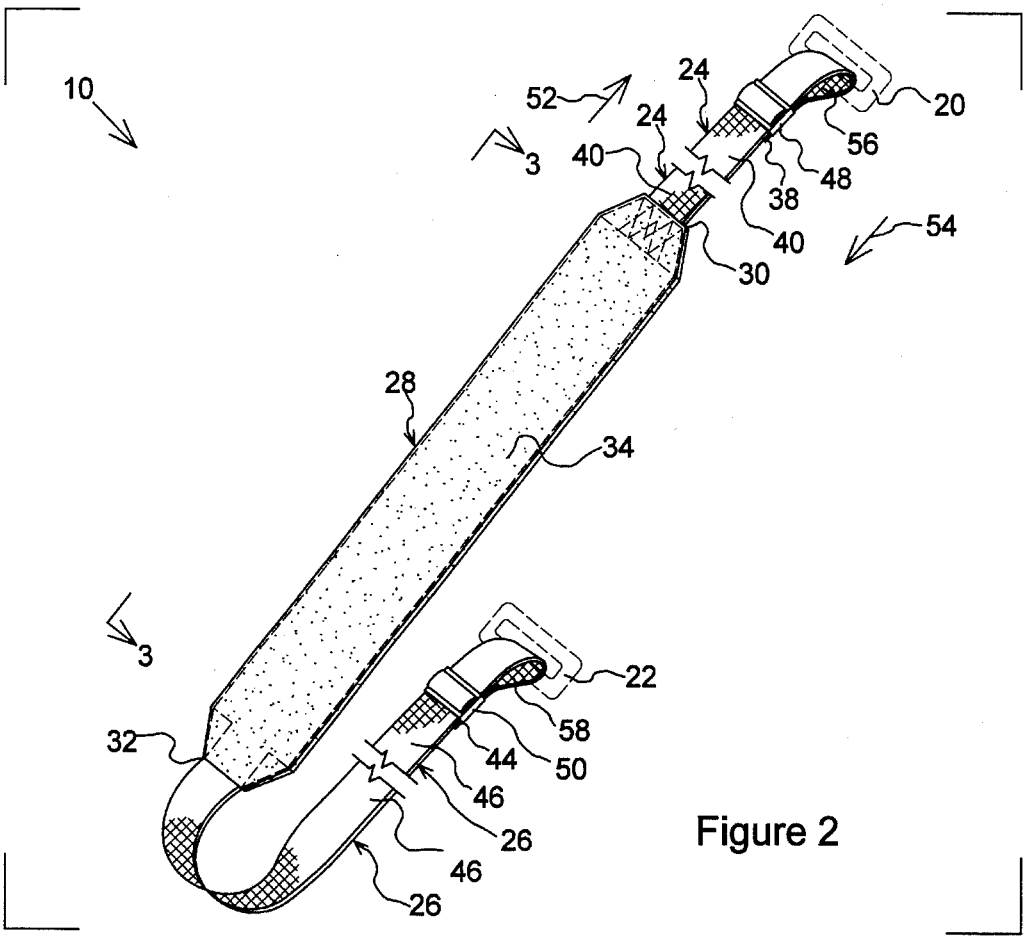
FIG. 2 is a perspective view of applicant's new and novel retractable carrying device.

Referring now to FIG. 2 of the drawings there is shown a perspective view of the new and novel retractable carrying device, shown generally by the numeral 10. A shielding means, shown generally by the numeral 28, having a closed end 30, open end 32 and body 34 is composed of a layered material and envelops an inner retractable mechanism which is not shown in FIG. 2 of the drawings for purposes of clarity. The layered construction of shielding means 28 and the inner retractable mechanism will be shown and described more fully hereinafter.

A first elongated flexible securing means shown generally by the numeral 24, having an end 36, an opposite end 38 and a body 40 is formed from high strength, tightly woven nylon webbing. Other materials may also be used, such as leather, reinforced vinyl, flexible plastic and the like, and are considered to be within the spirit and scope of the applicant's invention. The end 36 of the first elongated flexible securing means 24 cannot be seen in FIG. 2 but is clearly shown in FIG. 5 of the drawings.

Still referring to FIG. 2 of the drawings and in the Preferred Embodiment, a portion of the body 40 of the first elongated flexible securing means 24 is fixedly attached to and enveloped by the closed end 30 of the shielding means 28. The first elongated flexible securing means 24 is sewn into the closed end 30 of shielding means 28 with high strength thread using sewing techniques known in the art. In the Preferred Embodiment, a W—W stitch is used to secure a portion of the body 40 of the first elongated flexible securing means 24 into the closed end 30 of shielding means 28. The portion of the body 40 may be fixedly attached into the closed end 30 of the shielding means 28 by other methods known in the art such as gluing, clamping, riveting and other similar attaching techniques. Other fastening means and attaching techniques known in the art may also be used and are considered to be within the spirit and scope of the applicant's invention.

In FIG. 2 of the drawings there is also shown a second elongated flexible securing means shown generally by the numeral 26. The second elongated flexible securing means 26 is formed from high strength, tightly woven nylon webbing, and has an end 42, an opposite end 44 and body 46. Other materials may also be used, such as leather, reinforced vinyl, flexible plastic and the like, and are considered to be within the spirit and scope of the applicant's invention. The end 42 of the second elongated flexible securing means 26 cannot be seen in FIG. 2 but is clearly seen in FIG. 5 of the drawings.

Still referring to FIG. 2 of the drawings and in the Preferred Embodiment, a portion of the body 46 of the second elongated flexible securing means 26 is movably enveloped by shielding means 28 at open end 32 of the shielding means 28 thereby allowing the second elongated flexible securing means 26 to freely move a predetermined distance through the body 34 of shielding means 28. The movement of the second elongated flexible securing means 26 through the body 34 of shielding means 28 will be discussed more fully hereinafter.

The first and second elongated flexible securing means 24 and 26 have adjustable fastening means 48 and 50, respectively, adjustably attached thereto. The opposite end 38 of first elongated flexible securing means 24 is fed through adjustable fastening means 48 in the direction of arrow 52 and fed through receiving means or swivel 20, the swivel 20 being shown in dashed lines in FIG. 2 for purposes of clarity. The receiving means 20 is attached to a prior art firearm, as shown in FIG. 1 but not shown in FIG. 2. Other objects on which the retractable carrying device 10 may be used may also have a swivel or other receiving means capable of receiving the opposite end 38 of the first elongated flexible securing means 24.

Still referring to FIG. 2 of the drawings, the opposite end 38 is then looped back and fed through adjustable fastening means 48 in the direction of arrow 54, forming removable attaching means 56 thereby removably attaching the first elongated flexible securing means 24 to receiving means 20. The second elongated flexible securing means 26 is removably attached to receiving means or swivel 22, the swivel 22 being attached to a prior art firearm as shown in FIG. 1 but not shown in FIG. 2 for purposes of clarity, in a similar manner by feeding the opposite end 44 of the second elongated flexible securing means 26 through adjustable fastening means 50, through receiving means 22 and back through adjustable fastening means 50 forming removable attaching means 58. Thus, removable attaching means 56 and 58 are used to securely attach the new and novel retractable carrying device 10 to a prior art firearm or other object, such as golf bags, camera bags, tripods, sports bags, luggage and similar objects. Other types and configurations of adjustable securing means may also be used and are considered to be within the spirit and scope of the applicant's invention.

In the Preferred Embodiment, and in FIG. 2 of the drawings, the adjustable fastening means 48 and 50 are of the type commonly known as tri-glide or ladder loc adjustable fasteners. Other adjustable securing means known in the art may also be used and are considered to be within the spirit and scope of the applicant's invention. The adjustable fastening means 48 and 50 allow a user to adjust the effective length of the first elongated flexible securing means 24 and the second elongated flexible securing means 26 so that an object to which the retractable carrying device 10 is attached may be properly and comfortably carried from a user's shoulder, the shielding means 28 being positioned on the apex of the user's shoulder.

Figure 3:
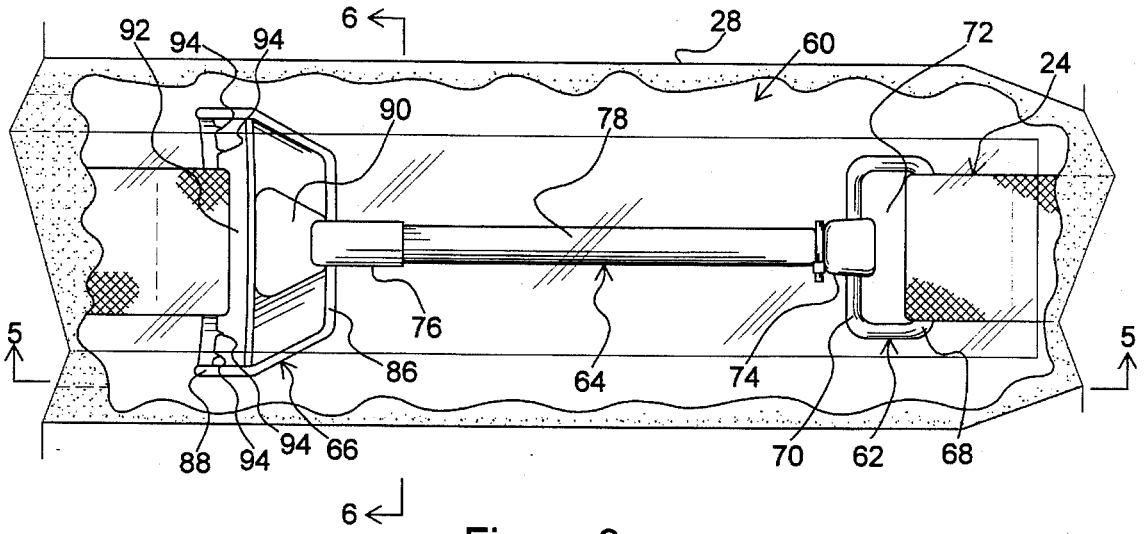
FIG. 3 is a top plan view of a portion of applicant's new and novel retractable carrying device showing a retractable mechanism taken along lines 3—3 of FIG. 2.

Referring now to FIG. 3 of the drawings there is shown a top plan view of a portion of applicant's new and novel retractable carrying device showing a retractable mechanism, the retractable mechanism being shown generally by the numeral 60, taken along lines 3—3 of FIG. 2. The retractable mechanism 60 is enveloped by shielding means 28, a portion of which has been removed in FIG. 3 of the drawings for purposes of clarity. The retractable mechanism 60 is comprised of a first connecting means 62, retracting means 64, and a second connecting means 66. In the Preferred Embodiment, first connecting means 62 is a jump ring having an end 68, opposite end 70 and opening 72 through which the first elongated flexible securing means 24 is attached. Split rings, snap rings, quick-link rings and other connecting means known in the art may also be used and are considered to be within the spirit and scope of the applicant's invention. The attachment of the first elongated flexible securing means 24 through the first connecting means 62 and to the end 68 of the first connecting means 62 will be discussed more fully hereinafter.

The retracting means 64, having an end 74, opposite end 76 and a body 78, is fixedly attached to the opposite end 70 first connecting means 62. The attachment of the end 74 of the retracting means 64 to the opposite end 70 of the first connecting means 62 will be discussed more fully hereinafter. In the Preferred Embodiment, the retracting means 64 is latex surgical tubing. The retracting means 64 has elastic properties and is of the type that can be stretched or extended when opposing directional force is applied to the retracting means 64, thereby increasing the effective length of the retracting means 64, and which will then return or retract to its original length when the opposing directional force is released. Rubber tubing, silicon tubing, flat rubber banding, bungee cord and other elastic materials may also be used and are considered to be within the spirit and scope of the applicant's invention. The surgical latex tubing in the Preferred Embodiment and shown in FIG. 3 of the drawings has been found to withstand repeated extension and retraction of the tubing without deterioration or breakage of the tubing.

Figure 4:
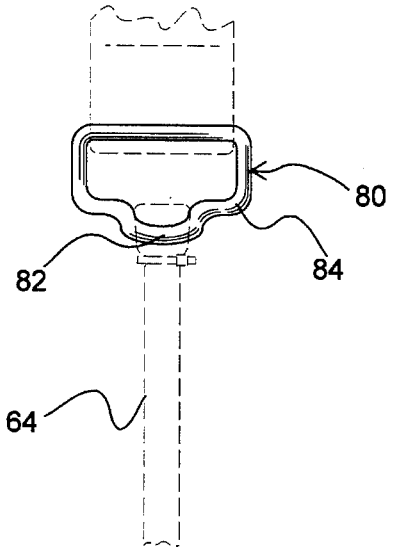
FIG. 4 is top plan view of a modified connecting means.

Referring briefly to FIG. 4 of the drawings there is shown a modified connecting means 80. The modified connecting means 80 is a self-centering jump ring having a centering portion 82 formed in end 84 of the modified connecting means 80. Other self-centering modified connecting means may also be used and are considered to be within the spirit and scope of the applicant's invention. The retracting means 64 is fixedly attached to the centering portion 82 of the modified connecting means 80, the retracting means 64 being shown in dashed lines in FIG. 4 of the drawings for purposes of clarity. The manner of attachment of the retracting means 64 to the centering portion 82 of the modified connecting means 80 will be discussed more fully hereinafter.

Referring now back to FIG. 3 of the drawings there is shown a second connecting means 66 having an end 86, opposite end 88, openings 90 and 92, and gripping means 94. In the Preferred Embodiment and in FIG. 3 of the drawings, the second connecting means 66 has been designed to have an opening 90 near the end 86 through which the opposite end 76 of the retracting means 64 is fixedly attached to the end 86 of the second connecting means 66 and an opening 92 near the opposite end 88 through which the second elongated flexible securing means 26 is fixedly attached to the opposite end 88 of the second connecting means 66. The manner of attachment of the opposite end 76 of the retracting means 64 to the end 86 of the second connecting means 66 and of the second elongated flexible securing means 26 will be discussed more fully hereinafter.

Still referring to FIG. 3 of the drawings, there is shown gripping means 94 continuously formed on opposite end 88 of the second connecting means 66. The gripping means 94 are designed in FIG. 3 and in the Preferred Embodiment as raised pointed areas which engage a portion of the second elongated flexible securing means 26 thereby preventing slippage of the second elongated flexible securing means 26 on the opposite end 88 of the second connecting means 66. A self-centering modified connecting means such as that shown in FIG. 4 of the drawings and as previously described, may also be used. Other designs and other connecting means configurations and other self-centering connecting means known in the art may also be used and are considered to be within the spirit and scope of the applicant's invention.

Figure 5:
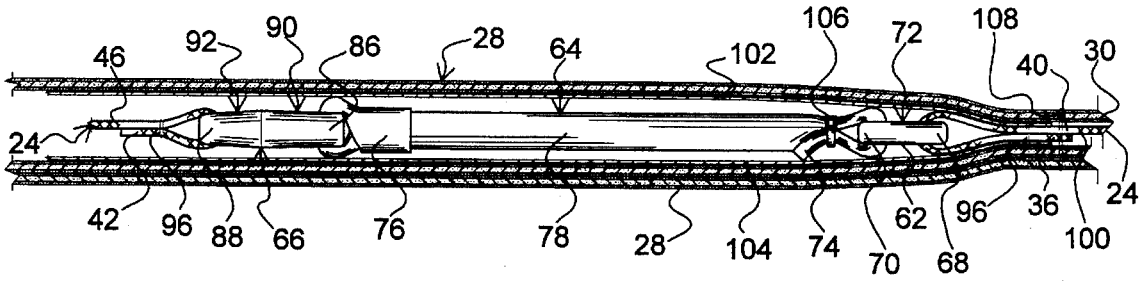
FIG. 5 is a sectional view of applicant's new and novel retractable carrying device taken along lines 5—5 of FIG. 3 of the drawings.

Referring now to FIG. 5 of the drawings there will be described in detail the attachment of the various elements of the applicant's new and novel retractable carrying device 10. FIG. 5 is a sectional view of applicant's new and novel retractable carrying device 10 taken along lines 5—5 of FIG. 3 of the drawings.

FIG. 5 of the drawings clearly illustrates the end 36 of the first elongated flexible securing means 24 is inserted through the opening 72 of the first connecting means 62, looped around the end 68 of the second connecting means 66 and fastened back onto the body 40 of the first elongated flexible securing means 24. The end 36 of the first elongated flexible securing means 24 is fixedly fastened onto the body 40 with high strength thread 96, as indicated by the dashed lines in FIG. 5 for purposes of clarity, using sewing techniques known in the art.

The first elongated flexible securing means 24 also has a side 98 and an opposite side 100. At least two flexible elongated friction reducing means 102 and 104 are also fixedly fastened, in a similar manner, onto the first elongated flexible securing means 24 so that flexible elongated friction reducing means 102 lays parallel to and adjacent to side 98 of the first elongated flexible securing means 24 and flexible elongated friction reducing means 104 lays parallel to and adjacent to opposite side 100 of the first elongated flexible securing means 24. The flexible elongated friction reducing means 102 and 104 will be discussed more fully hereinafter. The end 36 of the first elongated flexible securing means 24 may be fixedly fastened onto the body 40 of the first elongated flexible securing means 24 and the flexible elongated friction reducing means 102 and 104 may be fixedly fastened to the body 40 of the first elongated flexible securing means 24, by other methods known in the art such as gluing, clamping, riveting and other similar attaching techniques. Other fastening means and attaching techniques known in the art may also be used and are considered to be within the spirit and scope of the applicant's invention.

Similarly, the end 42 of the second elongated flexible securing means 26 is inserted through the opening 92 of the second connecting means 66, looped around the opposite end 88 of the second connecting means 66 and fastened back onto the body 46 of the second elongated flexible securing means 26. The end 42 of the second elongated flexible securing means 26 is also similarly fixedly fastened onto the body 46 with high strength thread 96, as indicated by the dashed lines in FIG. 5 for purposes of clarity, using sewing techniques known in the art. The end 42 of the second elongated flexible securing means 26 may be fixedly fastened onto the body 46 of the second elongated flexible securing means 26 by other methods known in the art such as gluing, clamping, riveting and other similar attaching techniques. Other fastening means and attaching techniques known in the art may also be used and are considered to be within the spirit and scope of the applicant's invention.

In the Preferred Embodiment, and in FIG. 5 of the drawings, opposite end 76 of the retracting means 64 is fixedly attached to the end 86 of the second connecting means 66 as will now be described. Opposite end 76 of the retracting means 64 is inserted through the opening 90 of the second connecting means 66 and looped around the end 86 of the second connecting means 66. The body 78 of the retracting means 64 is pierced near the opposite end 76 to create an opening through which the end 74 of the retracting means 64 is inserted. The body 78 of the retracting means 64 is then pulled through the opening created near the opposite end 76 of the retracting means 64 until the body 78 of the retracting means 64 is wrapped around and securely fastened to the end 86 of the second connecting means 66. The end 76 of the retracting means 64 may be fixedly attached to the end 86 of the second connecting means 66 by other methods known in the art such as gluing, clamping, riveting and other similar attaching techniques. Other fastening means and attaching techniques known in the art may also be used and are considered to be within the spirit and scope of the applicant's invention.

The end 74 of the retracting means 64 is fixedly attached to the opposite end 70 of the first connecting means 62 as will now be described. The end 74 of the retracting means 64 is inserted through opening 72 of the first connecting means 62, looped around the opposite end 70 of the first connecting means 62 and folded back onto the body 78 of the retracting means 64 and secured by fastening means 106. In the Preferred Embodiment and in FIG. 5 of the drawings, the fastening means 106 has been designed to be a cable tic. Cable ties have been found to securely fasten the end 74 of the retracting means 64 to the body 78 of the retracting means 64. The end 74 of the retracting means 64 may be fixedly attached to the opposite end 70 of the first connecting means 62 by other methods known in the art such as gluing, clamping, riveting and other similar attaching techniques. Other fastening means and attaching techniques known in the art may also be used and are considered to be within the spirit and scope of the applicant's invention.

The retracting means 64 may be similarly fastened to a modified connecting means 80, as shown in FIG. 4 and previously described, utilizing either of the above described methods of attachment. That is, the opposite end 76 of the retracting means 64 is inserted through the modified connecting means 80 and looped around the centering portion 82 of the modified connecting means 80 and fixedly attached as previously described. Alternatively, the end 74 of the retracting means 64 is inserted through the modified connecting means 80, looped around the centering portion 82 of the modified connecting means 80 and folded back onto the body 78 of the retracting means 64 and secured by fastening means 106 as previously described.

Still referring to FIG. 5 of the drawings, the closed end 30 of the shielding means 28 is fixedly attached to the body 40 of the first elongated flexible securing means 24 with high strength thread 108, as indicated by the dashed lines in FIG. 5 for purposes of clarity, using sewing techniques known in the art. In the Preferred Embodiment, a W—W stitch is used to secure the closed end 30 of the shielding means 28 to the body 40 of the first elongated flexible securing means 24, as is clearly shown in FIG. 2 of the drawings. Attachment of the shielding means 28 to the first elongated flexible securing means 24 in this manner creates a static end of the new and novel retractable carrying device 10. The static end of the retractable carrying device 10 will be discussed more fully hereinafter. The closed end 30 of the shielding means 28 may be fixedly attached to the body 40 of the first elongated flexible securing means 24 by other methods known in the art such as gluing, clamping, riveting and other similar attaching techniques. Other attaching means and attaching techniques known in the art may also be used and are considered to be within the spirit and scope of the applicant's invention.

Figure 6:
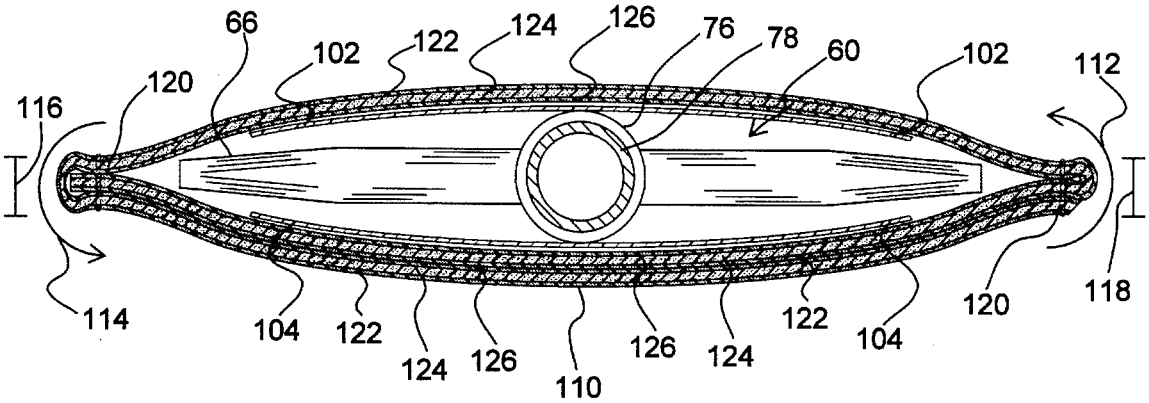
FIG. 6 is a sectional view of applicant's new and novel retractable carrying device taken along lines 6—6 of FIG. 3 of the drawings.

Referring now to FIG. 6 of the drawings there will be described in detail the enveloping effect and layered configuration of the shielding means 28. FIG. 6 is a sectional view of applicant's new and novel retractable carrying device 10 taken along lines 6—6 of FIG. 3 of the drawings. The shielding means 28 is oriented in FIG. 6 so that surface 110 of the shielding means 28 is the surface that would be next to the user's body.

The shielding means 28 is placed under the retractable mechanism 60 creating a first layer and wrapped or folded over the retractable mechanism 60 as indicated by the arrow 112, and then wrapped or folded under the first layer of the shielding means 28, as indicated by the arrow 114, to create a double layering or double padding effect as clearly illustrated and shown in FIG. 6 of the drawings. The double layer or double padding lays next to the user and over the user's shoulder when the new and novel retractable carrying device 10 is in the proper position on the user's shoulder providing a comfortable padding which insulates the user from the retractable mechanism 60. Edge portions 116 and 118 of the shielding means 28 are then sewn with high strength thread 120 using sewing techniques known in the art to close and lock the envelope. The edge portions 116 and 118 of the shielding means 28 may be closed and locked by other methods known in the art such as gluing, clamping, riveting and other similar techniques. Other securing means and techniques known in the art may also be used and are considered to be within the spirit and scope of the applicant's invention.

In the Preferred Embodiment, the shielding means 28 itself is composed of at least three individual layers. First layer 122 is Cordura®, 1000 denier. The first layer 122 provides a tough, durable outer surface of the shielding means 28. Second layer 124 is open cell foam and is bonded to the first layer 122. The second layer 124 provides a cushioning effect of the shielding means 28. Third layer 126 is Trico®. The third layer 126 is bonded to the second layer 124 and provides a smooth surface adjacent to the retractable mechanism 60. The third layer 126 also provides a protective coating over the open cell foam second layer 124 and helps prevent deterioration of the second layer 124 by the retractable mechanism 60. Other materials and other layered or non-layered constructions known in the art may also be used and are considered to be within the spirit and scope of the applicant's invention.

FIG. 6 also shows the positioning of the flexible elongated friction reducing means 102 and 104 within the shielding means 28 and over and under the retractable mechanism 60, respectively. The flexible elongated friction reducing means 102 and 104 cover the first connecting means 62, retracting means 64, second connecting means 66 and a portion of the second elongated flexible securing means 26 and is in turn enveloped by the shielding means 28 as is clearly shown in FIG. 5 of the drawings. The function of the flexible elongated friction reducing means 102 and 104 will be discussed more fully hereinafter.

Figure 7:
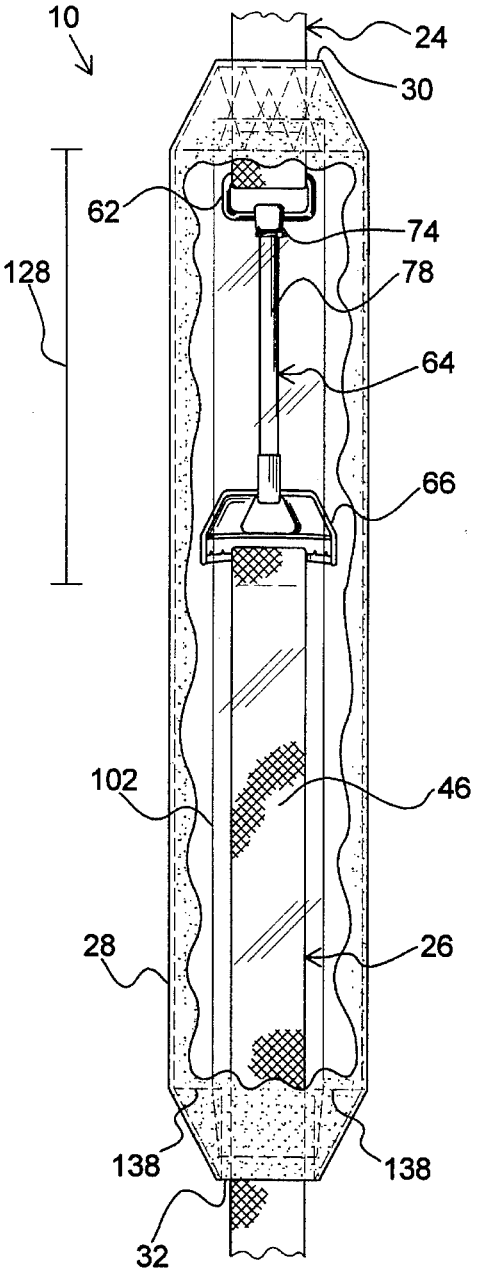
FIG. 7 is a top plan view of applicant's new and novel retractable carrying device shown in a retracted position.
Figure 8:
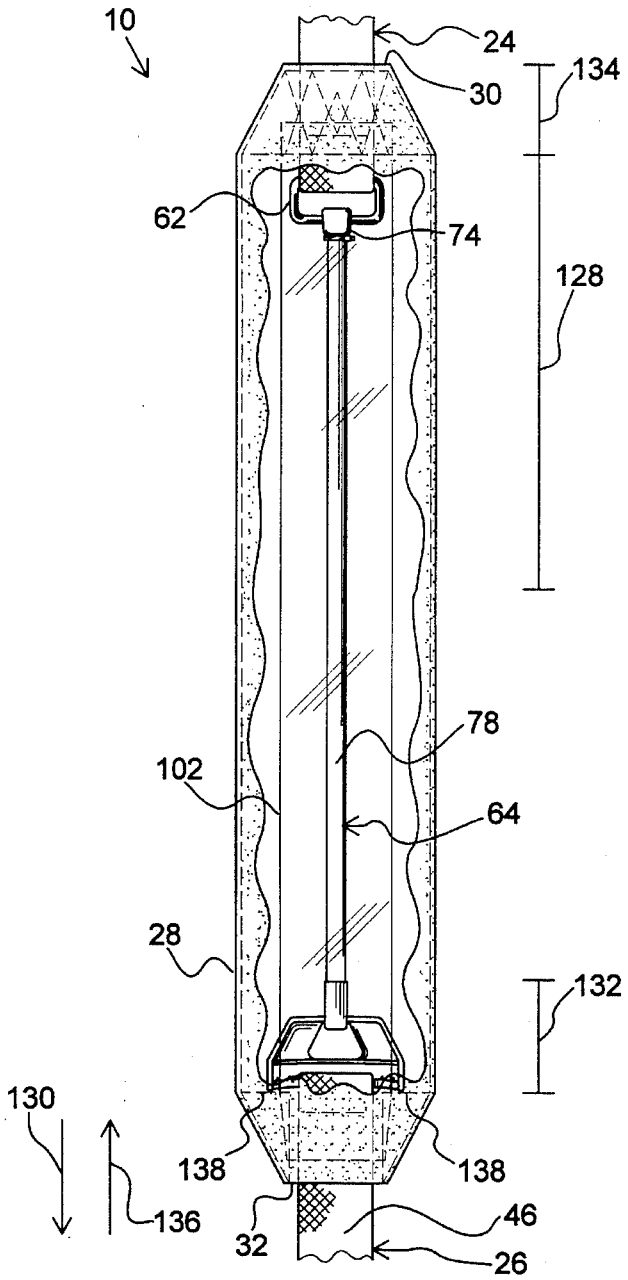
FIG. 8 is a top plan view of applicant's new and novel retractable carrying device shown in an extended position.

Referring now to FIGS. 7 and 8 of the drawings there will be described in detail the extension and retraction of the applicant's new and novel retractable carrying device 10. FIG. 7 is a top plan view of applicant's new and novel retractable carrying device shown in a retracted position. FIG. 8 is a top plan view of applicant's new and novel retractable carrying device shown in an extended position. A portion of the shielding means 28 has been removed in FIGS. 7 and 8 for purposes of clarity.

Referring now in particular to FIG. 7 of the drawings there is shown the new and novel retractable carrying device 10 in a retracted position. In the retracted position, the body 78 of the retracting means 64 is in a relaxed or retracted state. The second connecting means 66 is thereby positioned within an upper portion 128 of the shielding means 28 and a portion of the body 46 of the second elongated flexible securing means 26 is enveloped by and contained within the shielding means 28.

Referring now to FIG. 8 of the drawings there is shown the retractable carrying device 10 in an extended position. Since the second elongated flexible securing means 26 is movably enveloped by the shielding means 28 at the open end 32 of the shielding means 28, as previously described, a directional force, in the direction of the arrow 130, applied to the second elongated flexible securing means 26 pulls the body 46 of the second elongated flexible securing means 26 through the open end 32 of the shielding means 28 and also pulls the second connecting means 66 to a lower position 132 within the shielding means 28 thereby extending or stretching the body 78 of the retracting means 64. Since the first elongated flexible securing means 24 is securely fastened in the closed end 30 of the shielding means 28, and the first elongated flexible securing means 24 is adjustably fastened to a receiving means on a prior art object as previously described, a static end is created at closed end 30 of the shielding means 28 as indicated by the numeral 134.

When the body 78 of the retracting means 64 is extended or stretched, there is an intrinsic tendency, due to the elastic properties of the body 78 of the retracting means 64 and the resulting tension created by the extension, for the body 78 of the retracting means 64 to return to its original retracted or relaxed state in the direction of the arrow 136. The tendency of the body 78 of the retracting means 64 to return to the original retracted state urges the second connecting means 66 and the body 46 of the second elongated flexible securing means 26 to return to the upper portion 128 of the shielding means 28 thereby causing the new and novel retractable carrying device 10, and thus a prior art object to which the retractable carrying device 10 is attached, to fit snugly against the user's body.

Flexible elongated friction reducing means 102 and 104 provide a smooth, low friction surface against which the retractable mechanism 60 can easily slide when the retracting means 64, second connecting means 66, and body 46 of the second elongated flexible securing means 26 change position within the shielding means 28. Flexible elongated friction reducing means 104 is not visible in FIGS. 7 and 8 but is clearly shown in FIG. 6 of the of the drawings. Still referring to FIG. 8 of the drawings, the flexible elongated friction reducing means 102, and thus the flexible elongated friction reducing means 104, extend the length of the shielding means 28 covering the retracting means 64, second connecting means 66, and body 46 of the second elongated flexible securing means 26 to ensure free movement of the retracting means 64, second connecting means 66, and body 46 of the second elongated flexible securing means 26 within the shielding means 28. In the Preferred Embodiment, the flexible elongated friction reducing means 102 and 104 are thin sheets of polypropylene. Other flexible friction reducing material such as polystyrene, polyethylene, Teflon® and other materials known in the art may also be used and are considered to be within the spirit and scope of the applicant's invention.

Since the elastic properties of the body 78 of the retracting means 64 urges the second connecting means 66 and thus, the body 46 of the second elongated flexible securing means 26 to return to the upper portion 128 of the shielding means 28, a constant re-adjusting effect is created when the new and novel retractable carrying device 10 is in use. The constant re-adjusting effect allows the new and novel retractable carrying device 10 to have a shock absorbing effect allowing a user to comfortably carry an object for long periods of time. The shock absorbing effect also maintains constant tension on any receiving means, such as swivels, to which the new and novel retractable carrying device is fastened, thereby preventing the receiving means from creating undesirable noise while an object is being carried, removed from the user's shoulder or repositioned.

Additionally, the new and novel retractable carrying device further enhances stability of an object when it is used to stabilize the object. The elastic properties of the retracting means allows the retractable carrying device to automatically and tensionally adjust when the new and novel retractable carrying device is utilized as a stabilizing aid. For example, if the object to which the retractable carrying device 10 is attached is a firearm, and if a user aims the firearm at a target, a carrying device or sling attached to the firearm is often used to stabilize the non-trigger arm of the user. That is, a user aiming a firearm at a target will often place his or her non-trigger hand through a sling attached to the firearm and then grasp the forestock of the firearm, so that the user's forearm and upper arm are oppositely and partially encircled by the sling thereby stabilizing the user's arm and thus, the firearm. In this position a sling acts as a reinforcement for the non-trigger arm and allows the user to steady the firearm before firing.

The applicant's new and novel retractable carrying device 10 simplifies and further enhances the stabilizing effect of this procedure. The elastic properties of the body 78 of the retracting means 64 allows the retractable carrying device 10 to extend slightly when the user places his or her arm through the new and novel retractable carrying device 10. Once the user's arm is positioned properly, the elastic properties of the body 78 of the retracting means 64 retracts so that the retractable carrying device 10 fits snugly around the user's arm providing greater stability when the user is aiming a firearm in this manner. This example is provided by way of illustration only. The use of the retractable carrying device 10 as a stabilizing aid in other situations and with other objects is considered to be within the spirit and scope of the applicant's invention.

Still referring to FIG. 8 of the drawings, there is shown retaining means 138. The retaining means 138 are shown in FIG. 8 as dashed lines for purposes of clarity. Retaining means 138 limit lateral movement of the second elongated flexible securing means 26 but do not interfere with the free travel of the second elongated flexible securing means 26 through the open end 32 of the shielding means 28. The retaining means 138 have also been designed to retain the second connecting means 66 in the unlikely event that the retracting means 64 should break. The retaining means 138 limits the travel of the second connecting means 66 thereby preventing over-extension of the body 78 of the retracting means 64 and increasing the life of the retracting means 64. In the Preferred Embodiment, the retracting means 64 has been designed to withstand repeated extension and retraction as previously discussed. In the unlikely event that the retracting means 64 should break, the retaining means 138 prevents the second connecting means 66 from traveling past the open end 32 and out of the shielding means 28 thereby allowing a user to continue carrying an object from their shoulder. The adjustable fastening means 48 and 50, shown in FIG. 2 of the drawings and previously described, can then be used to shorten the first elongated flexible securing means 24 and the second elongated flexible securing means 26 of the retractable carrying device 10. The user can then continue to carry the object from their shoulder with the retractable carrying device 10. In the Preferred Embodiment, the retaining means 138 are formed from high strength thread using sewing techniques known in the art. Other retaining means known in the art such as staples, clamps, rivets and other similar retaining means may also be used and are considered to be within the spirit and scope of the applicant's invention.

Figure 9:
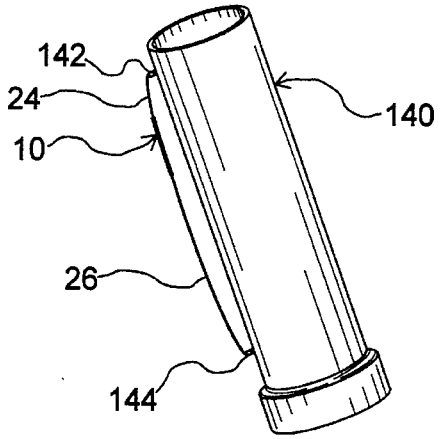
FIG. 9 is a perspective view of applicant's new and novel retractable carrying device in position on a golf bag.
Figure 12:
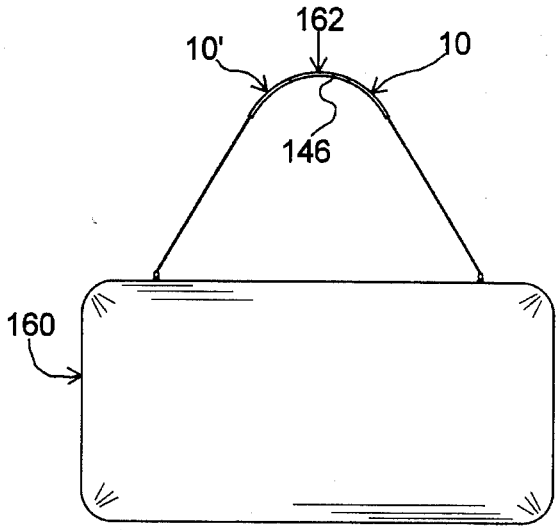
FIG. 12 is a side view of a modification of applicant's new and novel retractable carrying device in position on a garment bag.

Referring now to FIG. 9 of the drawings there is shown a perspective view of applicant's new and novel retractable carrying device 10 in position on a golf bag, shown generally by the numeral 140. FIG. 9 of the drawings is similar to FIG. 1 and is provided for purposes of illustration only. Applicant's new and novel retractable carrying device 10 has been designed to be utilized with a variety of prior art objects such as firearms, golf bags, camera bags, tripods, sports bags, luggage and similar objects. FIGS. 1, 9 and 12 of the drawings clearly illustrate the new and novel retractable carrying device 10 can be used with a variety of objects.

Still referring to FIG. 9 of the drawings, the prior art golf bag 140 has an upper receiving means 142 and a lower receiving means 144 attached to the golf bag 140. The first elongated flexible securing means 24 of retractable carrying device 10 is attached to the upper receiving means 142 and the second elongated flexible securing means 26 of retractable carrying device 10 is attached to the lower receiving means 144. The new and novel retractable carrying device 10 may be removably attached to upper receiving means 142 and lower receiving means 144 in a manner similar to the attachment of the retractable carrying device 10 to the receiving means or swivels of a prior art firearm as previously described. Other methods of attachment may also be used and are considered to be within the spirit and scope of the applicant's invention.

Figure 10:
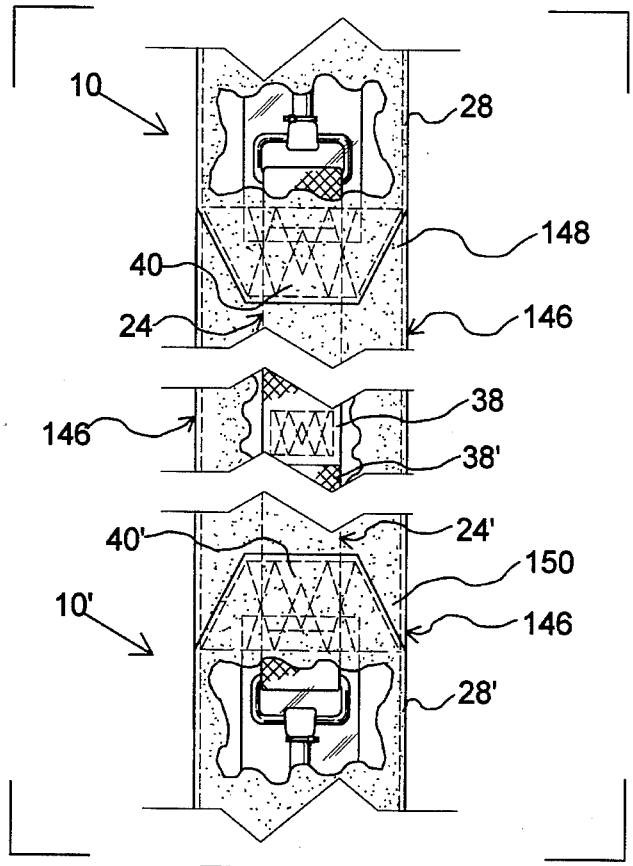
FIG. 10 is a top plan view showing a modification of applicant's new and novel retractable carrying device

Referring now to FIG. 10 of the drawings, there is shown a modification of applicant's new and novel retractable carrying device. FIG. 10 is a top plan view of a modification of the retractable carrying device. In this embodiment, at least two retractable carrying devices 10 and 10' are fixedly attached one to the other. Portions of the retractable carrying devices 10 and 10' are not shown in FIG. 10 for purposes of clarity but are similar to those shown in FIG. 3 of the drawings.

Still referring to FIG. 10 of the drawings, there is shown opposite end 38 of first elongated flexible securing means 24 fixedly attached to opposite end 38' of first elongated flexible securing means 24', thereby connecting retractable carrying device 10 and retractable carrying device 10' at the opposite end 38 and opposite end 38' respectively. The portion of the first elongated flexible securing means 24 and the first elongated flexible securing means 24' that lays between shielding means 28 and shielding means 28' is enveloped by modified shielding means 146, the modified shielding means 146 having ends 148 and 150, the ends 148 and 150 of the modified shielding means 146 being attached to shielding means 28 and shielding means 28', respectively. A portion of the modified shielding means 146 and the shielding means 28 and 28' have been removed in FIG. 10 of the drawings for purposes of clarity.

In this embodiment, modified shielding means 146 is attached to shielding means 28 and shielding means 28' with high strength thread using sewing techniques known in the art. The ends 148 and 150 of the modified shielding means 146 may be attached to the shielding means 28 and 28' by other methods known in the art such as gluing, clamping, riveting and other similar attaching techniques. Other fastening means and attaching techniques known in the art may also be used and are considered to be within the spirit and scope of the applicant's invention.

The modified shielding means 146 may also replace the shielding means 28 and shielding means 28'. The modified shielding means 146 being attached to the body 40 of the first elongated flexible securing means 24 and to the body 40' of the first elongated flexible securing means 24'. In this embodiment, modified shielding means 146 is attached to the body 40 and 40' with high strength thread using sewing techniques known in the art. The modified shielding means 146 may be attached to the body 40 and 40' of the first elongated flexible securing means 24 and 24' by other methods known in the art such as gluing, clamping, riveting and other similar attaching techniques. Other fastening means and attaching techniques known in the art may also be used and are considered to be within the spirit and scope of the applicant's invention.

Figure 11:
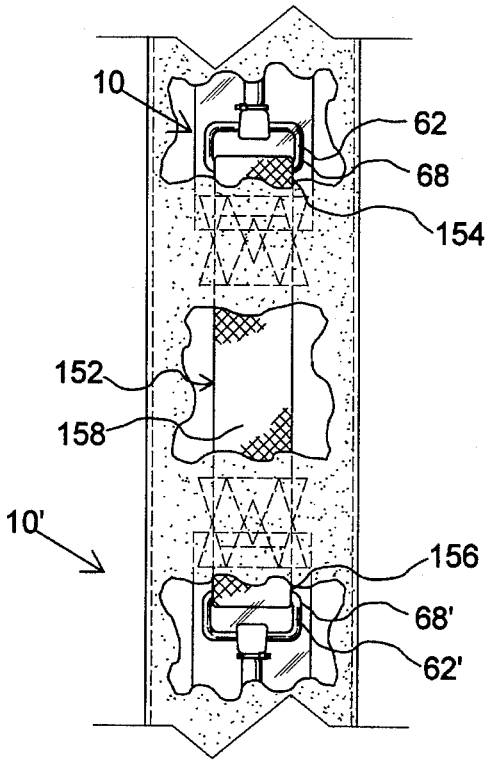
FIG. 11 is a top plan view showing another modification of applicant's new and novel retractable carrying device.

Referring now to FIG. 11 of the drawings there is shown another modification of applicant's new and novel retractable carrying device. FIG. 11 is a top plan view of another modification of the retractable carrying device. In this embodiment, at least two retractable carrying devices 10 and 10' are fixedly attached one to the other. Portions of the retractable carrying devices 10 and 10' are not shown in FIG. 11 for purposes of clarity but are similar to those shown in FIG. 3 of the drawings.

Still referring to FIG. 11 of the drawings there is shown a modified first elongated flexible securing means 152 having ends 154 and 156 and a body 158. The ends 154 and 156 of the modified first elongated flexible securing means 152 are fixedly attached to the ends 68 and 68', respectively, of the first connecting means 62 and 62', respectively. The manner of attachment of the ends 154 and 156 to the ends 68 and 68' of the first connecting means 62 and 62' is similar to the manner of attachment of the end 36 of the first elongated flexible securing means 24 to the end 68 of the first connecting means 62 as shown in FIG. 3 of the drawings and as previously described. Other methods of attachment may also be used and are considered to be within the spirit and scope of the applicant's invention.

Still referring to FIG. 11, the portion of the body 158 of the modified first elongated flexible securing means 152 that lays between shielding means 28 and shielding means 28' is enveloped by modified shielding means 146, the modified shielding means 146 being attached to shielding means 28 and shielding means 28' in a similar manner as shown in FIG. 10 of the drawings but which is not shown in FIG. 11.

The modified shielding means 146 is attached to shielding means 28 and shielding means 28' with high strength thread using sewing techniques known in the art. The modified shielding means 146 may be attached to the shielding means 28 and 28' by other methods known in the art such as gluing, clamping, riveting and other similar attaching techniques. Other fastening means and attaching techniques known in the art may also be used and are considered to be within the spirit and scope of the applicant's invention.

In FIG. 11, it is shown how the modified shielding means 146 replaces the shielding means 28 and shielding means 28', the modified shielding means 146 being attached to the body 158 of the modified first elongated flexible securing means 152, the shielding means 28 and 28' not shown in FIG. 11 for purposes of clarity. In this embodiment, modified shielding means 146 is attached to the body 158 of the modified first elongated flexible securing means 152 with high strength thread using sewing techniques known in the art. The modified shielding means 146 may be attached to body 158 of the modified first elongated flexible securing means 152 by other methods known in the art such as gluing, clamping, riveting and other similar attaching techniques. Other fastening means and attaching techniques known in the art may also be used and are considered to be within the spirit and scope of the applicant's invention. In this embodiment, the modified retractable carrying device is designed to be utilized with heavy prior art objects, for example, luggage, or where an additional shock absorbing effect is desired or preferable.

Referring now to FIG. 12 of the drawings there is shown a side view of a modification of applicant's new and novel retractable carrying device in position on a prior art garment bag, shown generally by the numeral 160. In this embodiment, the new and novel retractable carrying device is composed of at least two retractable carrying devices 10 and 10' and is attached to a prior art garment bag 160. It may be desirable to provide an additional shock absorbing effect when carrying an object that may be bulky or heavy such as the prior art garment bag 160 shown in FIG. 12. Since the midpoint 162 of the modified shielding means 146 lays on the apex of a user's shoulder, the retractable mechanisms 60 and 60', not shown in FIG. 12 of the drawing for purposes of clarity, will lay on a front side and a back side of the user's body thereby providing an additional or double shock absorbing effect when carrying such heavy or bulky objects.

From the above it can be seen that the applicant's new and novel retractable carrying device accomplishes all of the objects and advantages presented herein before. Nevertheless it is within the spirit and scope of the invention that changes in the applicant's basic retractable carrying device may be made and the Preferred Embodiment and the modifications shown and described herein have only been given by way of illustration.

Having described our invention, we claim:

1. A retractable carrying device for carrying an object, the object having receiving means to which the retractable carrying device is removably attached, the retractable carrying device allowing a user to carry the object for long periods of time without stress and irritation, comprising:

a. a first elongated flexible securing means having an end, an opposite end, a body, a side and an opposite side;

b. a retractable mechanism having a first connecting means, a retracting means and a second connecting means, the first connecting means of the retractable mechanism being fixedly attached to the end of the first elongated flexible securing means;

c. a second elongated flexible securing means, having an end, an opposite end and a body, the end of the second elongated flexible securing means being fixedly attached to the second connecting means of the retractable mechanism;

d. flexible elongated friction reducing means, the flexible elongated friction reducing means being fixedly attached to the side of the first elongated flexible securing means and to the opposite side of the first elongated flexible securing means thereby covering the retractable mechanism; and e. shielding means having a closed end, an open end, a body having length and retaining means, the closed end being fixedly attached around and to the body of the first elongated flexible securing means near the end of the first elongated flexible securing means, the body of the shielding means enveloping the flexible elongated friction reducing means and the retractable mechanism, wherein the flexible elongated friction reducing means extends the length of the body of the shielding means, the body of the second elongated flexible securing means is movably disposed through the open end of the shielding means and the retaining means prevent the second connecting means from moving past the open end of the body of the shielding means.

2. The retractable carrying device as defined in claim 1 wherein the first elongated flexible securing means is high strength flexible material.

3. The retractable carrying device as defined in claim 1, wherein the second elongated flexible securing means is high strength flexible material.

4. The retractable carrying device as defined in claim 1 wherein the retractable mechanism is self-centering.

5. The retractable carrying device as defined in claim 1 further comprising gripping means formed on the second connecting means, the gripping means designed to engage the second elongated flexible securing means.

6. The retractable carrying device as defined in claim 1 wherein the shielding means is composed of at least three layers.

7. The retractable carrying device as defined in claim 1 wherein the opposite end of the first elongated flexible securing means of at least two retractable carrying devices are attached one to the other, the first elongated flexible securing means of the at least two retractable carrying devices being enveloped by a modified shielding means.

8. The retractable carrying device as defined in claim 1 wherein opposite ends of a modified first elongated flexible securing means are attached to at least two retractable carrying devices, the modified first elongated flexible securing means of the at least two retractable carrying devices being enveloped by a modified shielding means.

9. A retractable carrying device for carrying an object, the object having receiving means to which the retractable carrying device is removably attached, the retractable carrying device allowing a user to carry the object for long periods of time without stress and irritation, comprising:

a. first elongated flexible securing means having an end, an opposite end, a body, a side and an opposite side and removable attaching means wherein the removable attaching means is removably attached to receiving means on an object;

b. a first connecting means having an end and an opposite end, the end of the first connecting means being fixedly attached to the end of the first elongated flexible securing means;

c. retracting means, the retracting means having an end, an opposite end and a body, the end of the retracting means being fixedly attached to the opposite end of the first connecting means;

d. a second connecting means having an end and an opposite end, the end of the second connecting means being fixedly attached to the opposite end of the retracting means;

e. a second elongated flexible securing means, having an end, an opposite end, a body and removable attaching means, the end of the second elongated flexible securing means being fixedly attached to the opposite end of the second connecting means, wherein the removable attaching means is removably attached to receiving means on an object;

f. flexible elongated friction reducing means, the flexible elongated friction reducing means being fixedly attached to the side of the first elongated flexible securing means and to the opposite side of the first elongated flexible securing means, the flexible elongated friction reducing means covering the first connecting means, the retracting means, the second connecting means and a portion of the second elongated flexible securing means; and g. shielding means having a closed end, an open end, a body having length and retaining means, the closed end being fixedly attached around and to the body of the first elongated flexible securing means near the end of the first elongated flexible securing means, the body of the shielding means enveloping the flexible elongated friction reducing means, the first connecting means, the retracting means and the second connecting means, wherein the flexible elongated friction reducing means extends the length of the body of the shielding means, the body of the second elongated flexible securing means is movably disposed through the open end of the shielding means and the retaining means prevent the second connecting means from moving out of and past the open end of the body of the shielding means.

10. The retractable carrying device as defined in claim 9 wherein the first elongated flexible securing means is high strength flexible material.

11. The retractable carrying device as defined in claim 9 wherein the second elongated flexible securing means is high strength flexible material.

12. The retractable carrying device as defined in claim 9 wherein the first connecting means is self-centering.

13. The retractable carrying device as defined in claim 9 further comprising gripping means formed on the opposite end of the second connecting means, the gripping means designed to engage the second elongated flexible securing means.

14. The retractable carrying device as defined in claim 9 wherein the second connecting means is self-centering.

15. The retractable carrying device as defined in claim 9 wherein the shielding means is composed of at least three layers.

16. The retractable carrying device as defined in claim 9 wherein the opposite end of the first elongated flexible securing means of at least two retractable carrying devices are attached one to the other, the first elongated flexible securing means of the at least two retractable carrying devices being enveloped by a modified shielding means.

17. The retractable carrying device as defined in claim 9 wherein opposite ends of a modified first elongated flexible securing means are attached to at least two retractable carrying devices, the modified first elongated flexible securing means of the at least two retractable carrying devices being enveloped by a modified shielding means.

18. A retractable carrying device for carrying an object, the object having receiving means to which the retractable carrying device is removably attached, the retractable carrying device allowing a user to carry the object for long periods of time without stress and irritation, comprising:

a. retracting means, the retracting means having an end, an opposite end and a body, the body of the retracting means being capable of extension and retraction;

b. a first connecting means having an end and an opposite end, the opposite end of the first connecting means being fixedly attached to the end of the retracting means;

c. a first elongated flexible securing means having an end, an opposite end, a body, a side and an opposite side and removable attaching means, the first elongated flexible securing means being fixedly attached to the end of the first connecting means, wherein the removable attaching means is removably attached to receiving means on an object;

d. a second connecting means having an end and an opposite end, the end of the second connecting means being fixedly attached to the opposite end of the retracting means;

e. flexible elongated friction reducing means, the flexible elongated friction reducing means being fixedly attached to the side of the first elongated flexible securing means and to the opposite side of the first elongated flexible securing means and covering the first connecting means, the retracting means, the second connecting means and a portion of the second elongated flexible securing means;

f. a second elongated flexible securing means, having an end, an opposite end, a body and removable attaching means, the end of the second elongated flexible securing means being fixedly attached to the opposite end of the second connecting means, wherein the removable attaching means is removably attached to receiving means on an object; and g. shielding means having a closed end, an open end, a body having length and retaining means, the closed end being fixedly attached around and to the body of the first elongated flexible securing means near the opposite end of the first elongated flexible securing means, the body of the shielding means enveloping the flexible elongated friction reducing means, the first connecting means, the retracting means and the second connecting means, the body of the second elongated flexible securing means being movably disposed through the open end of the shielding means, wherein the retaining means prevent the second connecting means from moving out of and past the open end of the body of the shielding means and the flexible elongated friction reducing means extends the length of the body of the shielding means reducing friction caused by the movement of the retracting means, the second connecting means and the body of the second elongated flexible securing means as they move within the body of the shielding means when the second elongated flexible securing means is subjected to a directional force.

19. The retractable carrying device as defined in claim 18 wherein the first elongated flexible securing means is high strength flexible material.

20. The retractable carrying device as defined in claim 18 wherein the second elongated flexible securing means is high strength flexible material.

21. The retractable carrying device as defined in claim 18 wherein the first connecting means is self-centering.

22. The retractable carrying device as defined in claim 18 further comprising gripping means formed on the opposite end of the second connecting means, the gripping means designed to engage the second elongated flexible securing means.

23. The retractable carrying device as defined in claim 18 wherein the second connecting means is self-centering.

24. The retractable carrying device as defined in claim 18 wherein the shielding means is composed of at least three layers.

25. The retractable carrying device as defined in claim 18 wherein the opposite end of the first elongated flexible securing means of at least two retractable carrying devices are attached one to the other, the first elongated flexible securing means of the at least two retractable carrying devices being enveloped by a modified shielding means.

26. The retractable carrying device as defined in claim 18 wherein opposite ends of a modified first elongated flexible securing means are attached to at least two retractable carrying devices, the modified first elongated flexible securing means of the at least two retractable carrying devices being enveloped by a modified shielding means.

27. A retractable carrying device for carrying an object, the object having receiving means to which the retractable carrying device is removably attached, the retractable carrying device allowing a user to carry the object for long periods of time without stress and irritation, comprising:

a. a modified first elongated flexible securing means having opposite ends;

b. at least two retractable mechanisms, each of the at least two retractable mechanisms having a first connecting means, a retracting means and a second connecting means, the first connecting means of one of the least two retractable mechanisms being attached to one of the opposite ends of the modified first elongated flexible securing means, the first connecting means of another of the least two retractable mechanisms being attached to another opposite ends of the modified first elongated flexible securing means;

c. a second elongated flexible securing means, having an end, an opposite end and a body, the end of the second elongated flexible securing means being fixedly attached to the second connecting means of the at least two retractable mechanisms;

d. flexible elongated friction reducing means, the flexible elongated friction reducing means being fixedly attached to the modified first elongated flexible securing means near the first connecting means of one of the at least two retractable mechanisms, the flexible elongated friction reducing means extending the length of the at least two retractable mechanisms and the second elongated flexible securing means thereby covering the at least two retractable mechanisms and the second elongated flexible securing means; and e. shielding means having open ends, and retaining means, the shielding means being attached to the modified first elongated flexible securing means and enveloping the at least two retractable mechanisms, wherein the body of one of the second elongated flexible securing means of one of the at least two retractable mechanisms is movably disposed through one of the open ends of the shielding means and the body of another of the second elongated flexible securing means of another of the at least two retractable mechanisms is movably disposed through another of the open ends of the shielding means, the retaining means preventing the second connecting means from moving past the open end of the body of the shielding means.

* * * * *